US005560406A

United States Patent [19]

Fineroff et al.

[11] Patent Number: 5,560,406

[45] Date of Patent: Oct. 1, 1996

[54] EASY DRIP DISPENSER

[76] Inventors: Geraldine R. Fineroff; Rebecca E. Fineroff, both of 2138 Hood Dr., Thousand Oaks, Calif. 91362

[21] Appl. No.: 517,034

[22] Filed: Aug. 21, 1995

[51] Int. Cl.[6] ..... B65B 1/00; B65B 3/00; B65C 3/00

[52] U.S. Cl. ..... 141/375; 141/88; 141/106; 141/364; 141/365; 248/311.3; 248/312

[58] Field of Search ..... 141/106, 364, 141/366, 375, 87, 88, 98, 363, 365, 369, 370; 248/94, 311.3, 312, 312.1, 222.4

[56] References Cited

U.S. PATENT DOCUMENTS

| | | | |
|---|---|---|---|
| 2,536,419 | 1/1951 | Brunell, et al. | 141/341 |
| 4,217,941 | 8/1980 | Catalano | 141/375 |
| 4,271,878 | 6/1981 | Bologa | 141/375 |
| 4,399,847 | 8/1983 | McRoberts | 141/364 |
| 4,454,897 | 6/1984 | Valiant | 141/364 |
| 5,080,150 | 1/1992 | Deadwyler, Jr. | 141/364 |
| 5,105,860 | 4/1992 | Connor | 141/106 |
| 5,146,957 | 9/1992 | Belokin, Jr. et al. | 141/106 |
| 5,297,600 | 3/1994 | Downes et al. | 141/364 |

*Primary Examiner*—Henry J. Recla
*Assistant Examiner*—Timothy L. Maust

[57] ABSTRACT

The Easy Drip Dispenser is a device for draining containers of liquid. It consists of a top 14, a support shelf 16 that sits horizontally just below the top, two sides 18, a back 20, and a base 22, all of which are molded from one piece of material in order to eliminate replacement parts. The front of the box is entirely open for easy access. The top contains, in its center, a top container entrance 12 into which a container neck is placed. The support shelf contains, in its center, a support container entrance 24 into which the container neck rests and is secured to prevent tipping. The device may sit on any counter top. Two keyholes 30 for screws and two two-sided heavy-duty tapes 28 are provided on the back for the purpose of attaching the device to a wall, if desired. A cup 26 sits on the base of the device to receive draining liquids. The device and the cup are made of a clear plastic material for ease of viewing draining liquids.

6 Claims, 5 Drawing Sheets

EASY DRIP DISPENSER

BACKGROUND—FIELD OF INVENTION

This invention relates to devices used to drain liquid from containers, specifically to improvements requiring no replacement parts, easier cleaning, and which are more economical to manufacture.

BACKGROUND—DESCRIPTION OF PRIOR ART

Over the years people have become more and more frustrated in their attempts to empty the last remaining liquid products from bottles such as shampoo, conditioner, and lotion, just to name a few. As the cost of purchasing these products continues to rise so does resentment to throwing the last of the product away. Getting the remaining product out of the container can be very aggravating.

Unless you are a commercial establishment using many containers of the same type at one time, the use of a device designed to empty the contents of one container into another partly empty similar container is impractical. We see this in U.S. Pat. No. 4,454,897 issued to Valiant in June 1984, and in U.S. Pat. No. 4,217,941 issued to Catalano in August 1980.

In U.S. Pat. No. 5,080,150 issued to Deadwyler, Jr. in January 1992, a bottle is held in an inverted position by use of a basket system while the bottle remains capped. Anyone who has ever tried this knows that it results in one of two problems. If you turn the bottle right-side up to remove the cap the contents of the bottle run back to the bottom and you are back where you started. If you try to remove the cap in the up-side down position it is extremely messy and you end up with a great deal more of the product than you want to use, thereby encouraging waste.

U.S. Pat. No. 4,399,847 issued to McRoberts in August 1983, uses a slender member inserted into the emptying bottle to suspend it. This method also proves extremely messy as the slender member is covered with the emptying liquid. U.S. Pat. No. 2,536,419 issued to Brunell in January 1951, uses a funnel to facilitate the flow of liquids from one container to another. Since liquid would get trapped in the funnel a constant cleaning would be necessary to prevent clogging. Additionally, this is another design intended for commercial use by filling one container to another partly empty similar container. In both cases above cleaning would be necessary between the emptying of every new container. U.S. Pat. No. 5,297,600 issued to Downes et al in March 1994, uses a flexible sleeve to suspend the container. This sleeve requires periodic replacement. Further, this invention contains moving parts that are subject to breakage. Finally, this invention contains posts as side supports. Airborne particles, such as dust, are free to enter the product container contaminating the liquid prior to use.

U.S. Pat. No. 5,146,957 issued to Belokin, Jr. in September 1992, uses a tapered cone-shaped receptacle to catch the emptying liquid. That receptacle is just as difficult to get the liquid out of as the original container. It is also very difficult to clean due to its shape.

U.S. Pat. No. 4,271,878 issued to Bologa in June 1991, uses a plurality of fingers to hold containers in place. These fingers are subject to stretching and breakage after a period of use.

U.S. Pat. No. 5,105,860 issued to Connor in April 1992, uses a large rectangular box as a support and cornered drawers to catch draining liquid. The box is not designed to attach to walls. The drawer is difficult to use as the liquid tends to collect in the squared corners. The user is unable to see if the fluid has completely drained before removing the drawer, which would cause a mess and loss of product if the fluid is still in the draining stage.

OBJECTS AND ADVANTAGES

Accordingly, the primary object and advantage of my dispenser is to provide a method for emptying containers of liquids into an easily accessible and viewable, alternative container.

Further advantages of my dispenser are:

It provides support for containers of various sizes, shapes and weights.

It is large enough to support containers yet small enough to fit almost anywhere.

It is comprised of only two parts.

It is easily used by persons with handicaps, such as arthritis.

No part of this dispenser will wear out or need replacement.

It is dishwasher safe.

The encasement protects the liquid from airborne elements.

The liquid receptacle is designed for easy viewing and removal of product.

It can be manufactured inca variety of pastel shades allowing a decorative look while not obstructing the users view.

Except for the cup, there are no parts that come in contact with the liquid so there is no mess.

It can be attached to a wall via screws or two-sided heavy-duty tape or it can sit on any vanity, counter, or dresser.

The clear material used in the manufacturing allows the user to see the status of the draining liquid.

And finally, the round cup allows all of a product to be used effortlessly while saving money.

Figure 1:
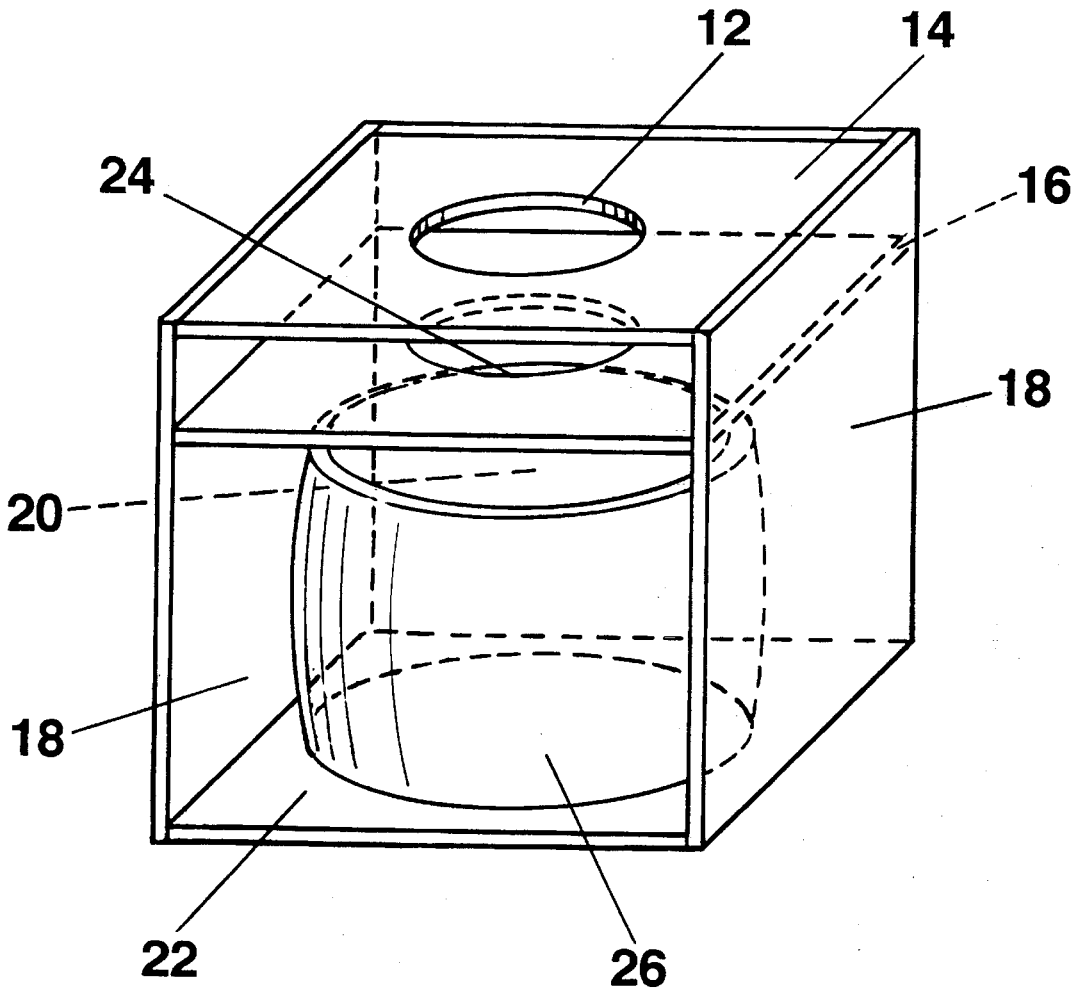
FIG. 1 An adequate explanation of how support shelf 16 is connected to the box by specifying that support shelf 16 is part of the one piece molded material.

| Reference Numerals in Drawings | |
|---|---|
| 12 top container entrance | 14 top |
| 16 support shelf | 18 side |
| 20 back | 22 base |
| 24 support container entrance | 26 cup |
| 28 two-sided heavy-duty tape | 30 keyhole |
| 32 center wall | 34 container |

DESCRIPTION—FIGS. 1 TO 5

FIG. 1 shows an overall front view of the dispenser, made of a light-weight clear material molded in one piece, except for a cup 26 which is separate. An outside shell is in the form of a box open only in the front. The box is comprised of a top 14, two sides 18, and a base 22. Also visible is a support shelf 16 designed to give added supports to an upside-down container. A top container entrance 12 and a support container entrance 24 are openings through which a container neck is placed for draining.

Figure 2:
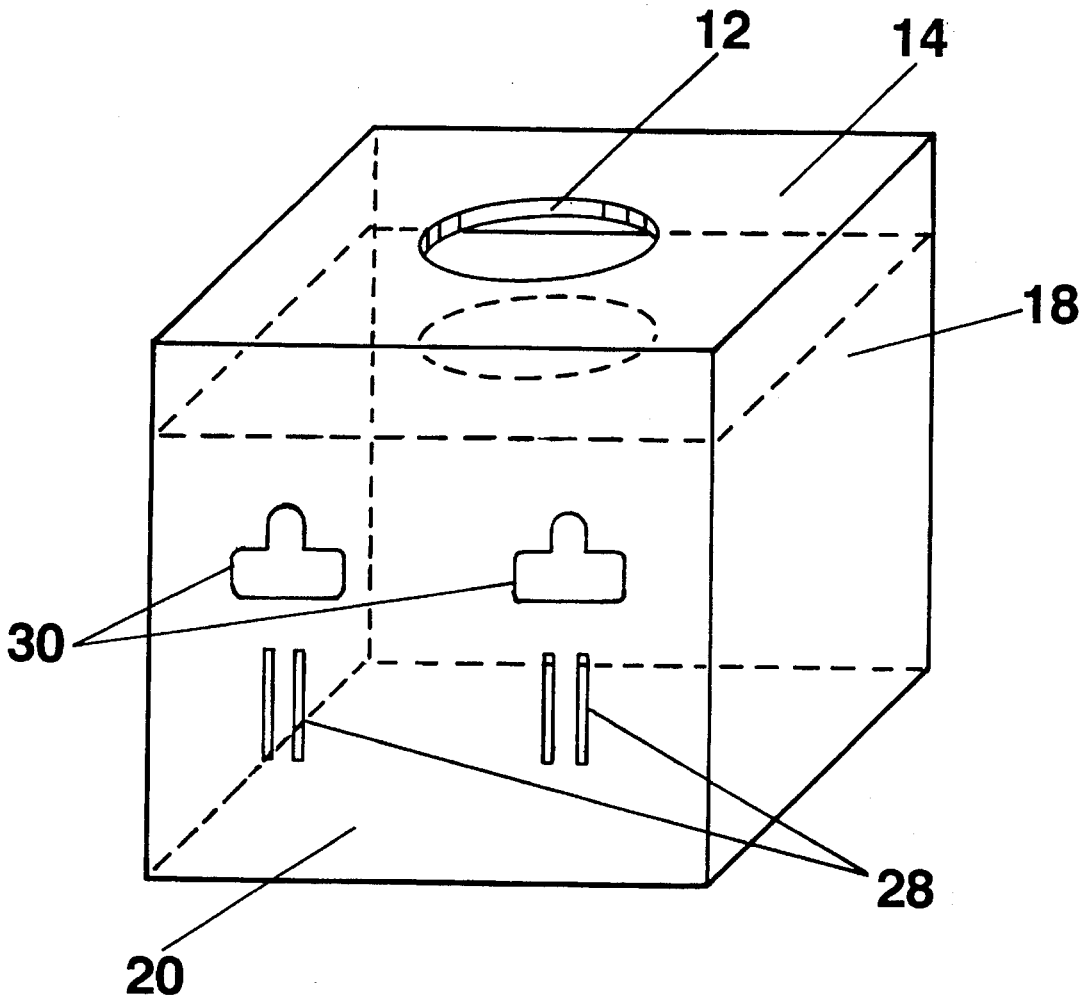
FIG. 2 is a perspective view of the rear of the dispenser.

FIG. 2 shows an overall rear view of the dispenser, including top 14, top container entrance 12, and one side 18. From this view two mounting methods are visible on a back panel 20. Two two-sided heavy-duty tapes 28 are provided for temporary mounting, and two keyholes 30 are provided for permanent mounting with screws.

Figure 3:
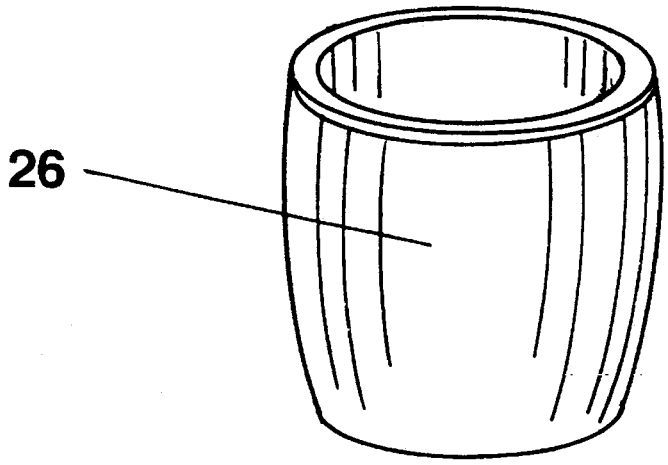
FIG. 3 is a perspective view of the cup receptacle.

FIG. 3 shows cup 26, rounded for easy removal of all liquid, made of a light-weight clear plastic for easily viewing the quantity of liquid stored within.

Figure 4:
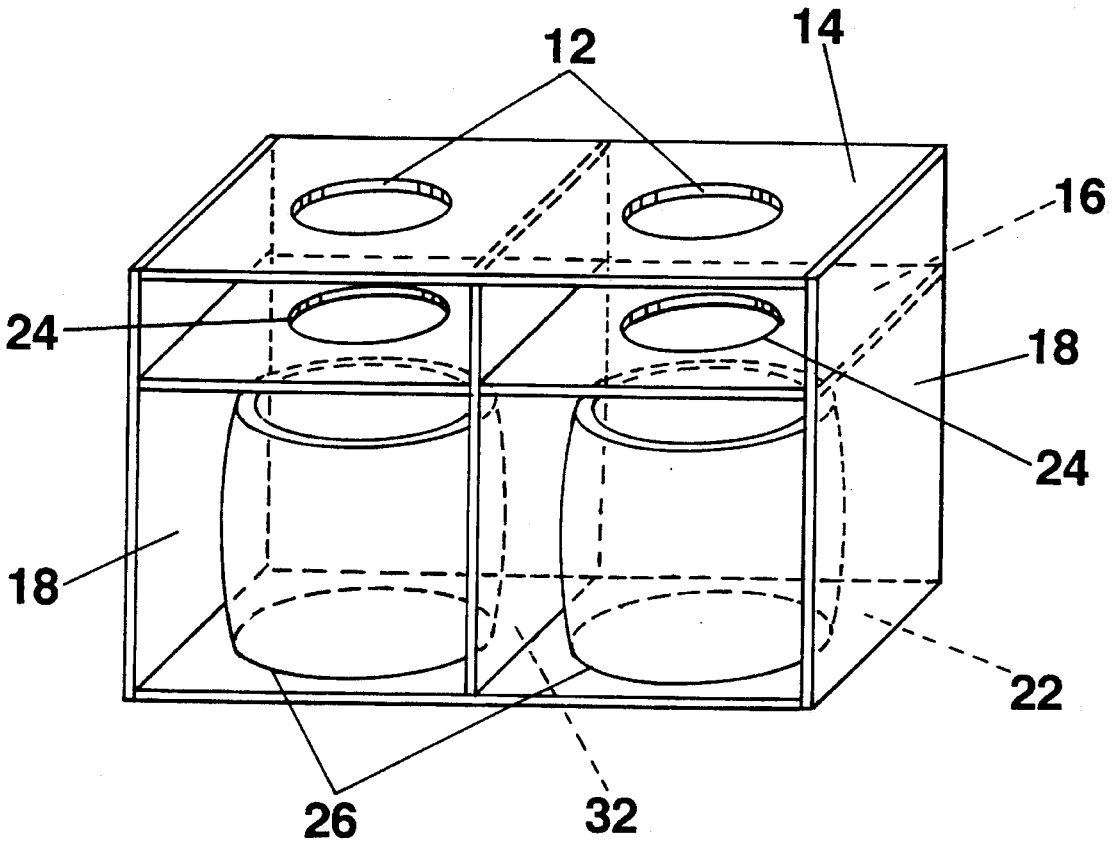
FIG. 4 is a perspective front view of a double-unit dispenser.

FIG. 4 shows a front view of a double-unit dispenser designed with a center wall 32 to allow the emptying of two containers at once.

Figure 5:
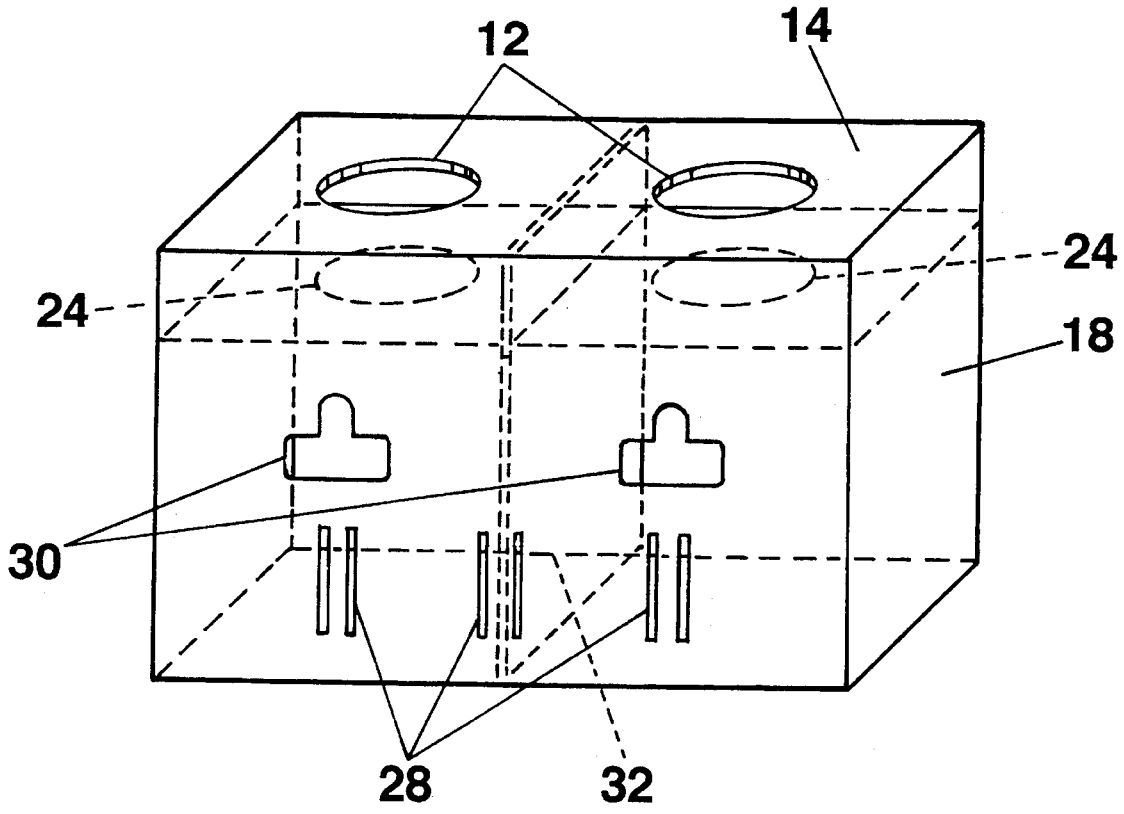
FIG. 5 is a perspective rear view of a double-unit dispenser.

FIG. 5 shows a rear view of a double-unit dispenser with an additional two-sided heavy-duty tape 28 for extra support.

Figure 6:
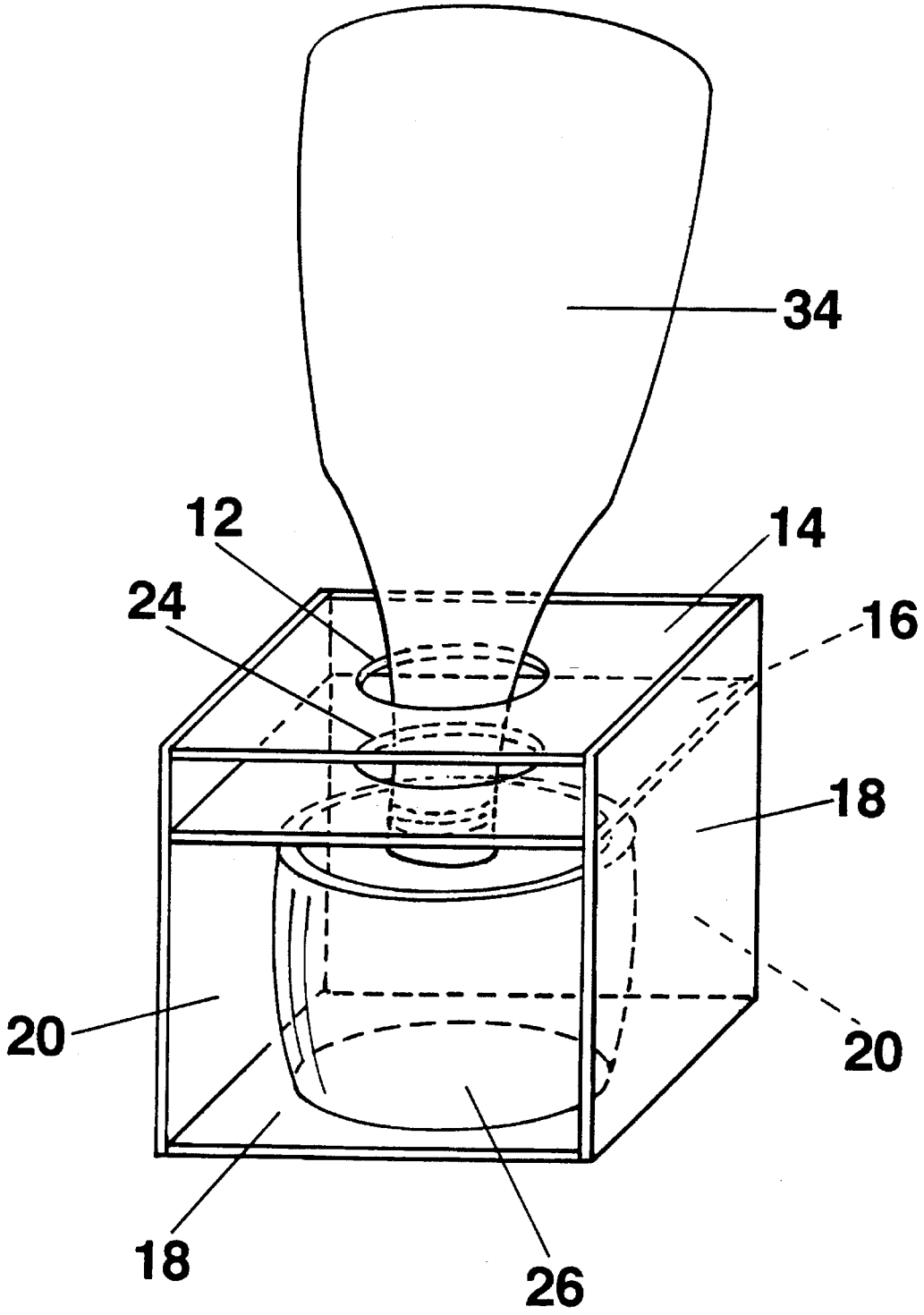
FIG. 6 is a front view of the dispenser with a container in the inverted position allowing its remaining product to run freely into the clear cup below.

FIG. 6 shows a front view of the dispenser in use accommodating a container 34 nestled in entrance 12 and entrance 24. Entrances 12 and 24 are of a sufficient size to accommodate all standard containers. It further demonstrates the flow of liquid from container 34 into cup 26.

OPERATION OF INVENTION—FIG. 6

The manner of using the Easy Drip dispenser to empty container 34 is by inverting it and placing its neck into entrance 12 and down through entrance 24 directly below. Container 34 rests there while the liquid inside flows out into cup 26 below as shown in FIG. 6.

There are no moving parts to break. There are no rubber parts to replace due to wear and tear. There are no parts, other than cup 26, that come in contact with the liquid. Thus, only cup 26 needs cleaning. Also, the entire dispenser is dishwasher safe. It is made of a clear material so that the user can easily see the status of draining or drained liquid.

Simply pull out cup 26 and use whatever amount of liquid is desired. Place cup 26 back in the dispenser for safe keeping and protection of the liquid from airborne elements.

CONCLUSION, RAMIFICATIONS, AND SCOPE OF INVENTION

Thus the reader will see that this dispenser provides a highly reliable, lightweight, and simple device that can be used by persons of almost any age. The intentional lack of moving or locking parts allows the dispenser to be used by persons with handicaps, such as arthritis.

The shape of the dispenser is designed to support all standard containers regardless of size, weight, or shape. In addition, the clear plastic material from which it is manufactured allows easy viewing. The key holes and two-sided heavy-duty tapes allow great versatility of placement on walls or counters. There are no parts to wear out or break. Therefore, the one-time, low purchase price provides an economical, permanent solution to wasted products. The user can easily re-coup the cost of the dispenser with savings realized by full use of products.

Although the description above contains many specificities, these should not be construed as limitations on the scope of the invention, but rather as an exemplification of one preferred embodiment thereof. Many other variations are possible. For example, the dispenser could be manufactured as a triple-unit, allowing three containers to empty at the same time. Further, the dispenser could be manufactured in pale colors allowing for a decorative coordination in any room, while still providing an uninterrupted view of the drained product. In another embodiment, top 14 would be manufactured of a ½" thick clear material and support shelf 16 would be eliminated. Accordingly, the scope of the invention should be determined by the appended claims and their legal equivalents, rather than by the examples given.

We claim:

1. A dispenser for holding a container in an inverted position so that its liquid content drains into a cup, comprising;

(a) a box having a top, base, back, two sides, an interior shelf and no front panel, molded from one piece of rigid material, (b) the top and shelf of said box each containing in their center an entrance the purpose of which is to substantially support a container in an upside-down position to prevent tipping, (c) the back of said box containing two keyholes for screws and two strips of two-sided heavy-duty tape, the purpose of which is to mount the dispenser to a wall, and (d) a circular shaped cup which sits approximately in the center of the base of said box, the purpose of which is to catch the draining liquid.

2. The dispenser of claim 1 wherein said rigid material is composed of clear plastic.

3. The dispenser of claim 1 wherein said rigid material is composed of pastel colored plastic for decorative purposes.

4. The dispenser of claim 1 wherein;

(a) said box is doubled in width to a rectangular shape, (b) one vertical piece of rigid material is molded into said box at the center so as to divide said box into two equal sections, (c) the back of said box containing two keyholes and three strips of two-sided heavy-duty tape, and (d) the top and support shelf containing two entrances each, the purpose of which is to substantially support two containers at the same time in an upside-down position without tipping to allow for the draining of said containers at one time into two cups.

5. The dispenser of claim 1 wherein;

(a) said box is tripled in width to a rectangular shape, (b) two vertical pieces of rigid material are molded in said box at equal distances so as to divide said box into three equal sections, (c) the back of said box containing three keyholes and four strips of two-sided heavy-duty tape, and (d) the top and support shelf containing three entrances each, thereby substantially supporting three containers at the same time in an upside-down position without tipping to allow for the draining of said containers into three cups.

6. The dispenser of claim 1 wherein the thickness of said top of said box is approximately ½" the purpose of which is to provide substantial support for said containers while eliminating the need for a support shelf.

* * * * *